United States Patent [19]

Kalomeris

[11] 4,446,574

[45] May 8, 1984

[54] BELTS WITH CONCEALED POCKETS

[76] Inventor: Mary Kalomeris, 303 W. 66th St., New York, N.Y. 10023

[21] Appl. No.: 373,192

[22] Filed: Apr. 29, 1982

[51] Int. Cl.[3] ..... A41F 19/00; A41D 27/20

[52] U.S. Cl. ..... 2/338; 2/247; 224/229

[58] Field of Search ..... 2/311, 312, 338, 247; 224/229

[56] References Cited

U.S. PATENT DOCUMENTS 1,920,061 7/1933 Carr ..... 2/247

2,503,157 4/1950 Knee ..... 2/338

*Primary Examiner*—Doris L. Troutman

*Attorney, Agent, or Firm*—James Creighton Wray

[57] ABSTRACT

A fashionable ladies belt intended for wearing on the outside of the clothing has relatively wide side and rear portions and a narrow closure portion, which may be tied, buckled or otherwise fastened. A pocket is constructed on the inside of the belt so that it overlies a side of a wearer. The pocket extends the full vertical dimension of the belt and has a horizontal dimension of about four to five inches. An inward opening near the top of the pocket is closed by a zipper.

6 Claims, 3 Drawing Figures

BELTS WITH CONCEALED POCKETS

BACKGROUND OF THE INVENTION

The carrying of money and valuables has always created a problem. The problem is especially acute in the case of women whose garmets often are devoid of pockets. Carrying money and valuables in purses creates vulnerability to loss and theft.

Heretofore, special arrangements for carrying money and valuables on the persons of women has been relegated to the use of belts or other carrying devices intended for securing beneath the outer clothing. Access to the money and valuables when desired is difficult or impossible when in public or in the company of other persons.

Some men's belts having pockets for carrying money or valuables are intended for wearing on the exterior clothing. Those belts are of a size which restricts the nature or amount of materials which may be concealed in the belts. Moreover, the belts must be removed before removing or adding concealed contents. Awkwardness and vulnerability attend the storing or retrieving material from men's externally worn money belts.

Collections of money belts are found in the U.S. Patent and Trademark Office in Class 224, Package and Article Carriers, subclasses 229 (money belts), 228, 227 and 224 and in Class 2, Apparel, subclasses 311 and 312.

Examples of U.S. patents found in those subclasses are:

U.S. Pat. No. De. 29,490,
U.S. Pat. No. De. 261,196,
U.S. Pat. No. 1,289,186,
U.S. Pat. No. 1,418,371,
U.S. Pat. No. 2,004,412,
U.S. Pat. No. 2,312,808,
U.S. Pat. No. 2,351,158.

The money belts shown in U.S. Pat. Nos. De. 29,490 and De. 261,196 are not intended to look like ordinary articles of clothing and the pockets are not concealed.

The money belts shown in U.S. Pat. Nos. 1,289,186; 1,418,371 and 2,351,158 do not appear as normal articles of clothing. The belt shown in U.S. Pat. No. 1,418,371 is intended to be worn under clothing. The belt shown in U.S. Pat. No. 1,289,186 requires awkward opening and sliding and revealing of the nature of the belt during its use. U.S. Pat. No. 2,351,158 is intended not to conceal the nature of the belt but rather to conceal the additional pockets within the belt. The men's belts shown in U.S. Pat. Nos. 2,004,412 and 2,321,808 have restricted pockets and require the removal of the belt before opening the pocket.

A need persists for a money belt, especially a belt for women, which can be worn outside the clothing, which can conceal money and valuables while concealing the special nature of the belt and which is easy to use without removing the belt from the person.

A fashionable ladies belt intended for wearing on the outside of the clothing has relatively wide side and rear portions and a narrow closure portion, which may be tied, buckled or otherwise fastened. A pocket is constructed on the inside of the belt so that it overlies a side of a wearer. The pocket extends the full vertical dimension of the belt and has a horizontal dimension of about four to five inches. An inward opening near the top of the pocket is closed by a zipper.

The fashion belt of the present invention is constructed to make the belt lie comfortably around the waist of the wearer. The belt is constructed so that its drape conceals the nature of the belt and conceals the pocket and articles stored within the pocket. Without removing the belt from the person of the wearer, the upper portion of the belt may be slightly bent outward to provide access to the slide fastener. When the slide fastener is slid, one may reach within the inner pocket to remove or add articles. The pocket is constructed in such a manner that one may access the entire inner area of the pocket with a normal comfortable maneuver during which others may not be aware that one is reaching within a pocket within a belt.

The particular construction of the belt keeps the upper edge of the belt tight against the body of the wearer except when a hand of the wearer is thrust under the belt to access the pocket.

The particular construction of the belt provides a draping of the belt around the body so that the belt creates its own contours while following the contours of the body so that the pocket is concealed within draped contours of the belt which appear normal.

In the preferred embodiment of the invention, the belt is cut with a downward curvature which forms a generally crescent shape when the belt lies flat and which forms a generally truncated conical shape when opposite ends of the belt are jointed together. Opposite lateral edges of the pocket are cut and attached to the belt in such a manner as to follow radii of upper and lower curvatures of the belt and to line lines which project to an imaginary apex of the truncated cone when opposite ends of the belt are connected. The pocket is free from medial potions of the belt to permit normal draping of the outer facial area of the belt. Upper and lower edges of the pocket are contoured similarly to contours of the belt to conceal the pocket within the belt and the upper and lower edges of the pocket are positioned in the inward turned upper and lower edges of the belt and are secured to the belt by the same bonding and stitching which secures the rolled edge to itself. Thus, the pocket is not apparent when viewing the belt.

Parallel stitches which extend between opposite ends of the belt provide the major longitudinally stability of the belt. In the preferred embodiment, the parallel stitching between ends of the belt is positioned closer to an upper edge of the belt than the lower edge of the belt. The slide opening in the pocket is positioned above the parallel stitches so that the slide opening may be concealed in the natural drape of the belt.

Belt apparatus of the present invention has a decorative facial shell of soft pliable leather having curved upper and lower edges and inward tapered first and second opposite ends. A pocket has upper and lower edges curved similar to upper and lower edges of the belt. In a preferred embodiment, lateral edges of the pocket are generally perpendicular to upper and lower curvilinear edges at positions of intersection therewith. Preferably the pocket is formed of an outer face and a backing stitched togehter along opposite lateral edges. In the preferred embodiment, the outer face of the pocket has an elongated opening spaced slightly downward from the upper edge. A slide fastener is positioned inside the opening and is stitched to the opening. Upper and lower edges of the belt are folded inward about upper and lower edges of the pocket and stitches secure the inward folded position of the edges of the belt around the lower edges of the pocket.

In preferred embodiments the pocket is mounted in a side portion of the belt.

Preferably, a second pocket is mounted in the belt in an opposite side portion of the belt.

A preferred embodiment of the belt has parallel stitches extending between the first and second opposite ends generally parallel to upper and lower edges and closer to the upper edge than the lower edge for preventing stretching of a mid-portion of the belt and promoting desired drape of the belt when worn.

Preferably the belt forms a generally crescent shape, and the lateral edges of the pocket generally lie along radii of the curvilinear upper and lower edges.

These and other and further objects and features of the invention are apparent in the disclosure which includes the above and ongoing description with the claims and the drawings.

DETAILED DESCRIPTION OF THE DRAWINGS

Figure 1:
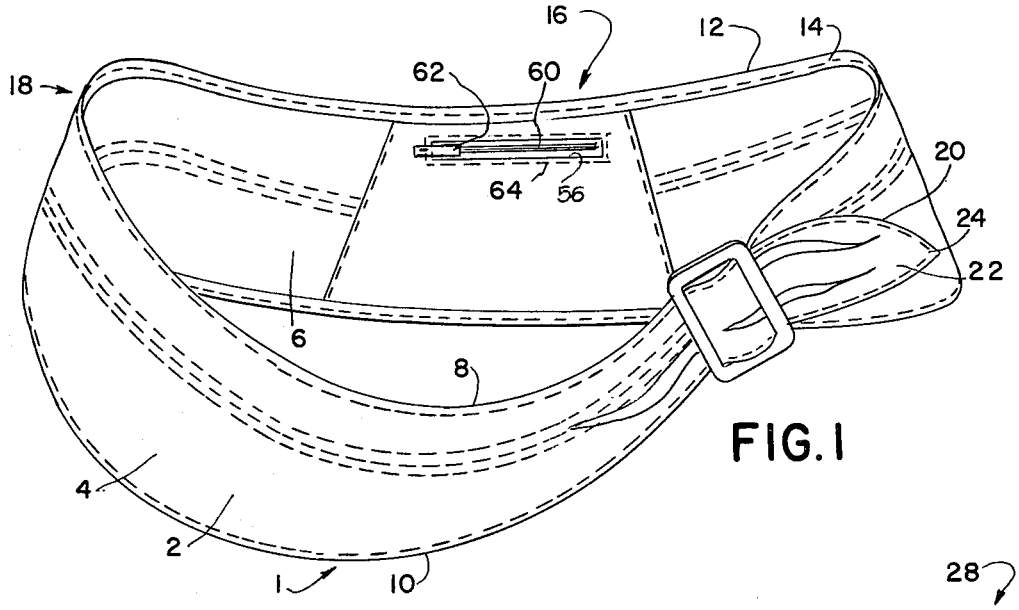
FIG. 1 shows a belt assembled.
Figure 2:
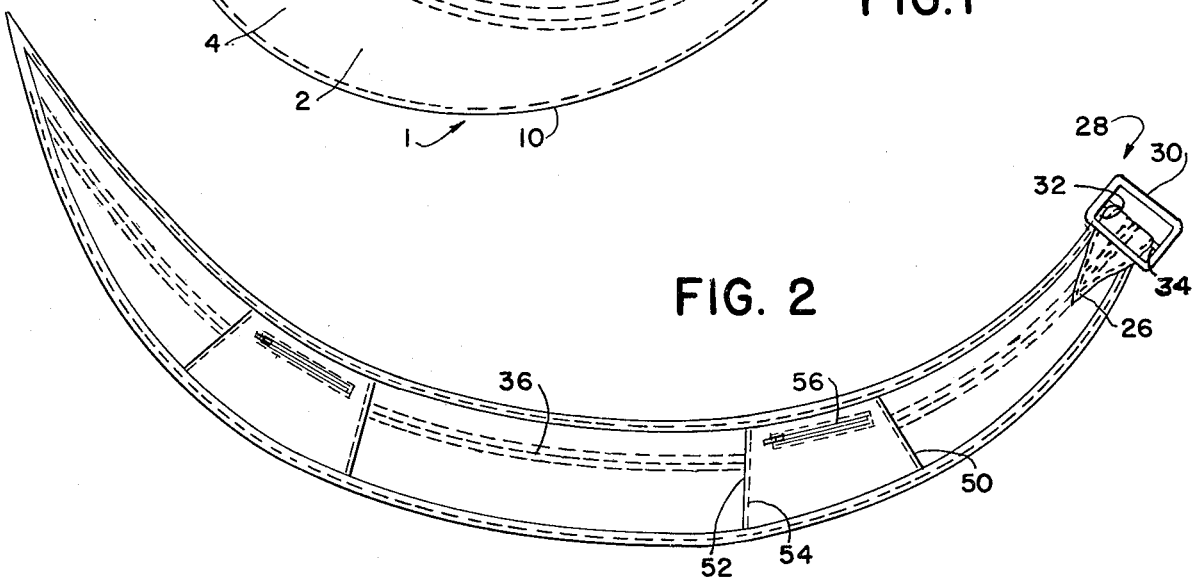
FIG. 2 is an inside view of the belt.
Figure 3:
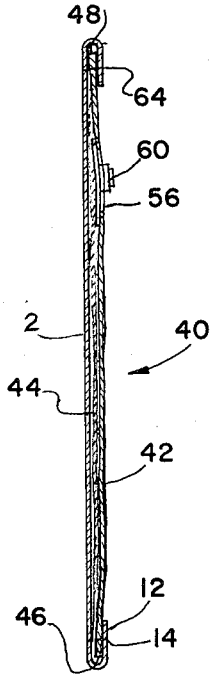
FIG. 3 is a schematic detail of a cross-section of the pocket and a belt.

Referring to FIG. 1, a belt is generally indicated by the numeral 1.

In a preferred embodiment, the belt is made of a high quality supple thin leather shell 2. The shell has a finished outer face 4 and an inner face 6. The belt may be made of any suitable material.

Upper and lower edges of the belt are curved upwardly to provide a generally crescent shape and a generally truncated conical shape when the belt is worn. Upper edge 8 and lower edge 10 are concentrically curved upwardly in a preferred embodiment. Alternatively, upper and lower edges 8 and 10 may have a similar curvature with centers displaced about 4½ or 5 inches. Preferably, the curvature of the upper edge 8 is greater and the curvature of the lower edge 10 is lesser so that the belt drapes about a body of a wearer. Upper and lower edges of the belt are rolled inwardly. Stitches 14 hold the roll 12. Inner faces of the roll may be coated with a binding agent before stitching.

The belts have side portions 16, rear portions 18 and end portions 20. Curvature of the upper and lower edges may be varied so that the side portions 16 and rear portions 18 are of similar height.

In a preferred embodiment of the belt, a first end 22 tapers to a point 24. A second end 26 is passed through a buckle 28 and is secured on an inside of the belt to hold the buckle in position. Specifically, end 26 is passed outward through opening 30 in buckle 28 around a center piece 34 and inward through a second opening 32 before bonding and stitching end 26 to the inside of the belt. A series of parallel stitches 36 extend from the first end 22 to the second end 26 of the belt. Stitches 36 are generally parallel to the upper edge 8 and lower edge 10 and are positioned nearer the upper edge 8 than the lower edge 10. The stitches 36 maintain longitudinal stability and discourage stretching of the belt or ballooning of a medial portion of the belt when the belt is worn.

One or more pockets 40 are mounted on the inside of the belt. Pockets 40 are formed of a face 42 and a backing 44, which are both made of a fine quality thin supple leather in a preferred embodiment. Other materials may be employed.

Lower edge 46 of the pocket is cut curvilinearly similar to the lower edge 10 of the belt. Upper edge 48 is cut curvilinearly concave the same as the upper edge 8 of the belt. First and second side edges 50 and 52 of the face 42 and backing 44 are angularly oriented with each other and are cut to be generally perpendicular to the curves of the upper and lower edges 8 and 10 at points of intersection. Side edges 50 and 52 are positioned along imaginary lines extending from an apex of a cone in which the assembled belt generally lies. Stitches 54 connect the innerface 42 and the backing 44 along edges 50 and 52. Edges 50 and 52 and stitches 54 are free from the belt shell 2.

Innerface 42 has an opening 56 beneath which a slide fastener 60 with a slide 62 is mounted. Stitches 64 connect the slide fastener 60 to face 42 of pocket 40. Preferably, the opening 56 is coordinated so that the slide fastener 60 is above stitches 36 in the belt wall 2.

Lower and upper edges 46 and 48 of pocket 40 are closed by stitches 14 which secure the rolled edge 12 of the belt. Bonding may be employed if desired.

In a preferred method of construction the belt blank is cut with the curved upper and lower edges 8 and 10 and the tapered opposite ends 22 and 26. Stitches 36 which extend from point to point of opposite ends 20 are added. Pocket faces 42 and 44 are cut with curvatures similar to the curvatures of respective upper and lower edges of the belt. An opening 56 is cut in the pocket face 42 and a slide fastener 60 is mounted beneath the opening with stitches 64. Side edges 50 and 52 of pocket 40 are connected with stitches 54. A bonding material is spread along upper and lower edges of the flattened belt. One or more pockets 40 are placed on the inside 6 of the belt on areas which will place the pockets on sides of the belt wearer. The coated upper and lower edges are turned inwardly on the upper and lower edges of the pockets and on themselves to form rolled edges 12. Stitches 14 are added to close the upper and lower edges of the pocket while securing the pocket to the belt and fixing the rolled edge 12. End 26 is inserted through buckle 28 and is stitched to the belt.

When one wears the belt, tip 24 is inserted through the second opening 32 and then the first opening 30 in the belt buckle 28, and the belt is drawn tight. Stitches 36 tend to hold the central portion of the belt inward. The remainder of the belt may follow the general contours of the body, forming a drape characteristic of supple leather. The threads 36 tend to hold the contents within pockets 40 inward and the drape of the belt disguises the edges of the pocket and conceals contents therein.

When one uses the belt, fingers may be inserted beneath the upper edge to move the slide 62. Fingers then can be inserted in the open slide fasteners. If the pocket is on a person's right side, slight leaning to the left may make access to the pocket even easier.

While the invention has been described with reference to a specific embodiment, one skilled in the leather working art will appreciate that modifications and variations of the invention may be constructed without departing from the scope of the invention which is defined in the following claims.

I claim:

1. Belt apparatus comprising a decorative facial shell of soft pliable material having similarly curved upper and lower edges and having inward tapered first and second opposite ends, thereby forming a general crescent shape, the belt having parallel stitches extending between the first and second opposite ends generally parallel to upper and lower edges and closer to the upper edge than the lower edge for preventing stretching of a mid-portion of the belt and promoting desired drape of the belt when worn, a pocket having curvilinear upper and lower edges curved similar to upper and lower edges of the belt and having opposite first and second lateral edges generally perpendicular to upper and lower curvilinear edges at positions of intersection therewith, whereby the lateral edges generally lie along radii of the curvilinear upper and lower edges, the pocket being formed of an outer face and a backing of similar size and shape stitched together along opposite lateral edges, the outer face of the pocket having an elongated opening therein spaced slightly downward from the upper edge thereof, and a side fastener positioned inside the opening and stitched to the opening along edges thereof, whereby the opening is selectively closed and opened by moving a slide on the slide fastener along the opening, the upper and lower edges of the belt being rolled inward about upper and lower edges of the pocket and stitches securing the inward rolled position of the edges of the belt and securing upper and lower edges of the pocket within the inward rolled upper and lower edges of the belt, a buckle having first and second openings separated by a cross-piece, the buckle being secured to the belt by passing one tapered end out through one opening in the buckle, around the cross-piece and back through the second opening in the buckle and securing the tapered end to an inside of the belt, whereby the second end may be secured to the buckle by passing the second tapered end outward through the second opening in the buckle, around the cross-piece and inward through the first opening in the buckle.

2. The belt apparatus of claim 1 wherein the pocket is mounted in a side portion of the belt.

3. The belt apparatus of claim 1 further comprising a second pocket mounted in the belt in an opposite side portion of the belt.

4. Belt apparatus comprising a decorative facial shell of soft pliable material having similarly curved upper and lower edges and having inward tapered first and second opposite ends, a pocket having upper and lower edges curved similar to upper and lower edges of the belt and having opposite first and second lateral edges generally perpendicular to upper and lower curvilinear edges at positions of intersection therewith, the pocket being formed of an outer face and a backing of similar size and shape stitched together along opposite lateral edges, the outer face of the pocket having an elongated opening therein spaced slightly downward from the upper edge thereof, and a slide fastener positioned inside the opening and stitched to the opening along edges thereof, whereby the opening is selectively closed and opened by moving a slide on the slide fastener along the opening, the upper and lower edges of the belt being rolled inward about upper and lower edges of the pocket and stitches securing the inward rolled position of the edges of the belt and securing upper and lower edges of the pocket within the rolled upper and lower edges of the belt, and means associated with the first and second opposite ends for securing the ends together.

5. Belt apparatus of claim 2 wherein the belt has parallel stitches extending between the first and second opposite ends generally parallel to upper and lower edges and closer to the upper edge than the lower edge for preventing stretching of a mid-portion of the belt and promoting desired drape of the belt when worn.

6. The belt apparatus of claim 4 wherein the belt forms a generally crescent shape and whereby the lateral edges of the pocket generally lie along radii of the curvilinear upper and lower edges.

* * * * *